US006394071B2

(12) United States Patent
Nitta et al.

(10) Patent No.: US 6,394,071 B2
(45) Date of Patent: May 28, 2002

(54) FUEL SUPPLY SYSTEM OF DIESEL ENGINE

(75) Inventors: Shinya Nitta; Yoshiki Ihara; Hisaki Toorisaka; Hiroshi Horiuchi, all of Tokyo (JP)

(73) Assignee: Hino Motors, Ltd., Tokyo (JP)

( * ) Notice: Subject to any disclaimer, the term of this patent is extended or adjusted under 35 U.S.C. 154(b) by 0 days.

(21) Appl. No.: 09/901,768

(22) Filed: Jul. 10, 2001

(30) Foreign Application Priority Data

Jul. 11, 2000 (JP) ..... 2000-209579

(51) Int. Cl.[7] ..... F02M 37/04
(52) U.S. Cl. ..... 123/456; 123/468
(58) Field of Search ..... 123/456, 468, 123/469, 470

(56) References Cited

U.S. PATENT DOCUMENTS 3,402,703 A * 9/1968 Dickerson et al. ..... 123/468
3,924,583 A * 12/1975 Jardin ..... 123/468
4,384,557 A * 5/1983 Johnson ..... 123/468
5,297,523 A * 3/1994 Hafner et al. ..... 123/456
5,533,485 A * 7/1996 Bronkal ..... 123/456
5,765,534 A * 6/1998 Brown et al. ..... 123/470
5,959,602 A * 9/1999 Shinohara ..... 123/509
6,076,505 A * 6/2000 Guggenmos et al. ..... 123/456
6,269,796 B1 * 8/2001 Mitchell ..... 123/468

* cited by examiner

*Primary Examiner*—Thomas N. Moulis
(74) *Attorney, Agent, or Firm*—Reed Smith LLP

(57) ABSTRACT

There are provided with a plurality of injection nozzles one ends of which are respectively inserted into a cylinder head every cylinder and other ends of which are covered with a cylinder head cover. A single common rail provided in parallel with a crankshaft is connected to a fuel injection pump through a first fuel pipe and connected to each injection nozzle through a plurality of second fuel pipes. The common rail is housed in the cylinder head cover, the front end of a first short pipe protruded from the common rail faces a first insertion portion formed in the sidewall of the cylinder head, and the first fuel pipe is connected to the first short pipe through the first insertion portion. Thereby, it is possible to decrease a fuel supply system using the common rail in weight and cost and improve the outside quality.

12 Claims, 7 Drawing Sheets

FUEL SUPPLY SYSTEM OF DIESEL ENGINE

CROSS-REFERENCES TO RELATED APPLICATIONS

This application claims priority of Japanese Application No. 2000-209579 filed Jul. 11, 2000, the completed disclosure of which is hereby incorporated by reference.

BACKGROUND OF THE INVENTION

1. Field of the Invention

The present invention relates to a fuel supply system of a diesel engine using a common rail for pressing and holding a fuel to be supplied to each injection nozzle of an engine.

2. Description of the Related Art

As shown in FIG. 16, in the case of the fuel supply system of this type, a single fuel injection pump 102 and a single common rail 103 is conventionally provided for the outside of an engine 101. The single common rail 103 is provided at the fuel injection pump 102 installed below an intake manifold 109 in parallel with a crankshaft. One end of each of a plurality of injection nozzles 106 is inserted into a cylinder head 104 every cylinder and the other ends of the injection nozzles are covered with a cylinder head cover 105. The common rail 103 is connected to the fuel injection pump 102 through a single first fuel pipe 107 and connected to the injection nozzles 106 through a plurality of second fuel pipes 108. The common rail 103 holds a pressurized fuel to be supplied to each injection nozzle 106. Reference numeral 115 in FIG. 16 denotes a pressure sensor for detecting a fuel pressure in the common rail 103.

However, in the case of the above conventional diesel-engine fuel supply system, it is necessary to lay out a plurality of second fuel pipes 108 at the outside of the engine 101 while avoiding interference objects as shown in FIG. 16. Therefore, these second fuel pipes 108 respectively become long and have a complex shape and thereby, there arise problems in that the weight of a fuel supply system increases and the manufacturing cost increases.

SUMMARY OF THE INVENTION

It is an object of the present invention to provide a diesel-engine fuel supply system decreased in weight and cost and improved in outside quality.

It is another object of the present invention to provide a diesel-engine fuel supply system allowing an inexpensive pressure sensor having a low oil resistance to be used as a pressure sensor for detecting a fuel pressure in a common rail by preventing oil in a cylinder head cover from being splashed on.

The first aspect of the present invention is improvement of an engine including a plurality of injection nozzles one ends of which are respectively inserted into a cylinder head every cylinder and other ends of which are covered with a cylinder head cover and a single common rail provided in parallel with a crankshaft, the common rail being connected to a fuel injection pump through a single first fuel pipe and being connected to a plurality of injection nozzles through a plurality of second fuel pipes.

The characteristic configuration lies in the fact that the common rail is housed in a cylinder head cover, the front end of a first short pipe protruded from the common rail faces a first insertion portion formed in the sidewall of the cylinder head, and the first fuel pipe is connected to the first short pipe through the first insertion portion.

According to the diesel-engine fuel supply system of the first aspect, it is possible to decrease the length of a second fuel pipe for connecting between each injection nozzle provided every cylinder and a common rail and it is only necessary to dispose not a plurality of second fuel pipes but the single first fuel pipe at the outside of a cylinder head cover.

The second aspect of the present invention further comprises a pressure sensor for detecting a fuel pressure in a common rail, wherein the front end of a second short pipe protruded from the common rail protrudes outward by passing through a second insertion portion formed in the sidewall of a cylinder head and the pressure sensor is installed at the front end of the second short pipe.

According to the diesel-engine fuel supply system of the second aspect, the pressure sensor is located at the outside of the cylinder head cover. Therefore, oil in the cylinder head cover is hardly splashed on the pressure sensor.

DESCRIPTION OF THE PREFERRED EMBODIMENTS

A first embodiment of the present invention will now be described below with reference to the accompanying drawings.

Figure 1:
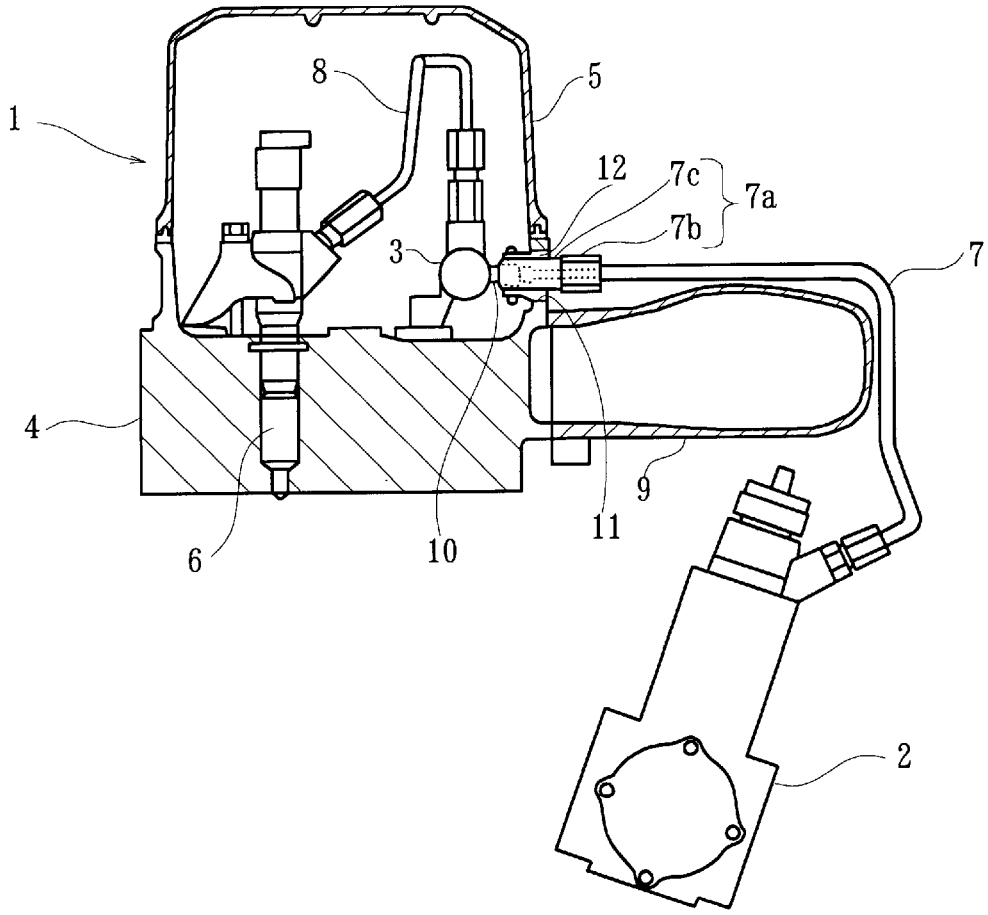
FIG. 1 is a sectional view taken along the line A—A in FIG. 3 showing a diesel-engine fuel supply system of a first embodiment of the present invention.
Figure 2:
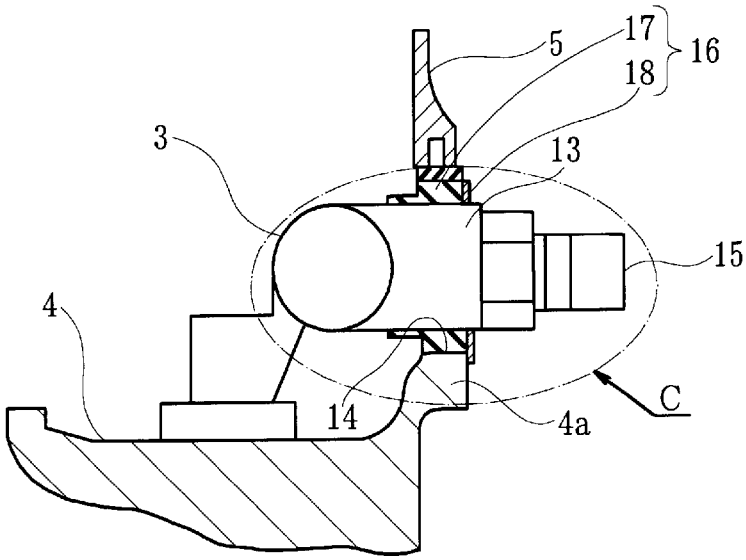
FIG. 2 is a sectional view taken along the line B—B in FIG. 3.
Figure 3:
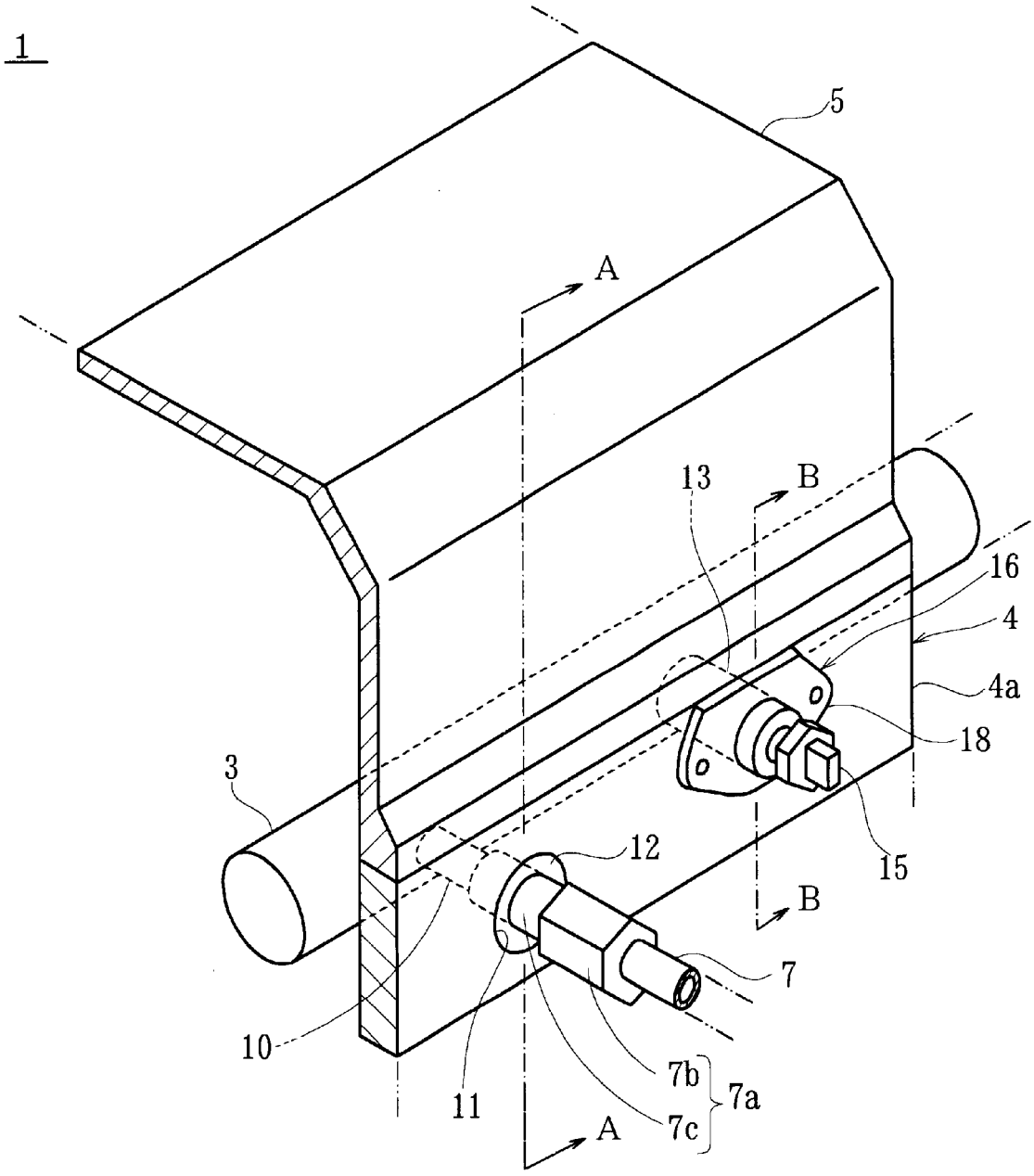
FIG. 3 is a perspective view of an essential portion including a common rail of the fuel supply system in FIG. 1.

As shown in FIGS. 1 to 3, the fuel supply system of a diesel engine 1 includes a plurality of injection nozzles 6 one ends (bottom ends) of which are respectively inserted into a cylinder head 4 every cylinder and a single common rail 3 installed on the upper face of the cylinder head 4 so as to be parallel with a not-illustrated crankshaft. The upper face of the cylinder head 4 is covered with a cylinder head cover 5 (FIG. 1). Thereby, other ends (upper ends) of the injection nozzles 6 protruded from the upper face of the cylinder head 4 are also covered with the cylinder head cover 5 and the common rail 3 is also housed in the cylinder head cover 5. Moreover, the common rail 3 is connected to a fuel injection pump 2 through a single first fuel pipe 7 and connected to a plurality of injection nozzles 6 through a plurality of second fuel pipes 8. Furthermore, the fuel injection pump 2 is disposed at the outside of the engine 1.

A first short pipe 10 and a second short pipe 13 are protruded from the common rail 3 (FIG. 3). The front end of the first short pipe 10 faces a through-hole 11 (first insertion portion) circularly formed in the sidewall 4*a* of the cylinder head 4 and an end of the first fuel pipe 7 is connected to the front end of the first short pipe 10 through a nut 7*a*. A male screw (not illustrated) is formed at the front end of the first short pipe 10 and a female screw (not illustrated) which can be screwed to the male screw is formed in the nut 7*a*. The nut 7*a* has a hexagonal portion 7*b* and a cylindrical portion 7*c* which is loosely inserted into the through-hole 11. The nut 7*a* is previously rotatably fitted at the end of the first fuel pipe 7 and the female screw of the nut 7*a* is screwed to the male screw of the first short pipe 10 in a state in which the cylindrical portion 7*c* is loosely inserted into the through-hole 11. Moreover, the gap between the cylindrical portion 7*c* of the nut 7*a* and the through-hole 11 is closed by a first sealing member 12 (FIGS. 1 and 3). The fuel pressurized by the fuel injection pump 2 is constituted so as to be held by the common rail 3 housed in the cylinder head cover 5, thereby supplied to each injection nozzle 6.

As shown in FIG. 2 and FIGS. 4 to 6, the second short pipe 13 protrudes toward the outside of the cylinder head 4 by passing through a cutout 14 (second insertion portion) almost formed into a U shape in the sidewall 4*a* of the cylinder head 4 and a pressure sensor 15 for detecting a fuel pressure in the common rail 3 is installed at the front end the pipe 13. Moreover, the gap between the outer periphery of the second short pipe 13 and the inner periphery of the cutout 14 is closed by a second sealing member 16. The pressure sensor 15 is constituted so as to detect a fuel pressure in the common rail 3 and a control unit (not illustrated) is constituted so as to optimally control a fuel pressure in the common rail 3 in accordance with a detection output of the pressure sensor 15.

Figure 4:
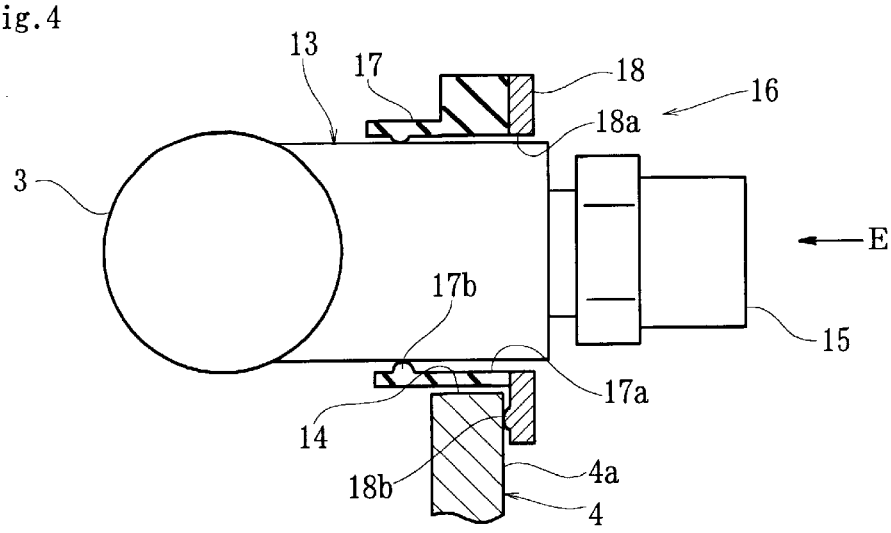
FIG. 4 is an enlarged sectional view of the portion C in FIG. 2.
Figure 5:
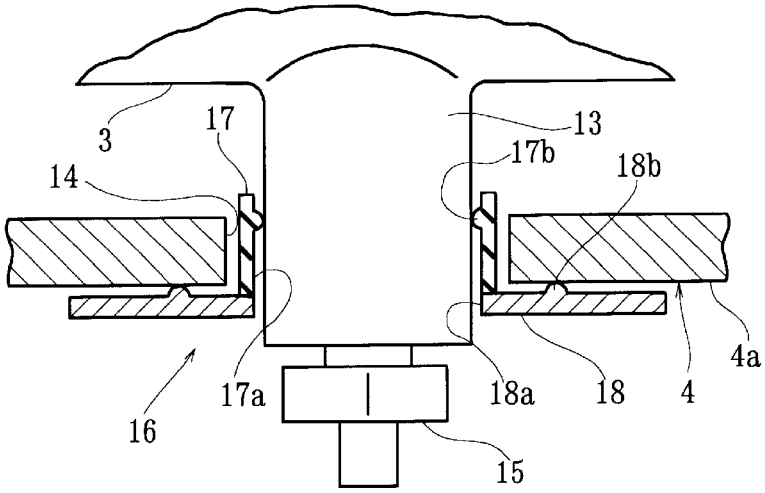
FIG. 5 is a sectional view taken along the line D—D in FIG. 6.
Figure 6:
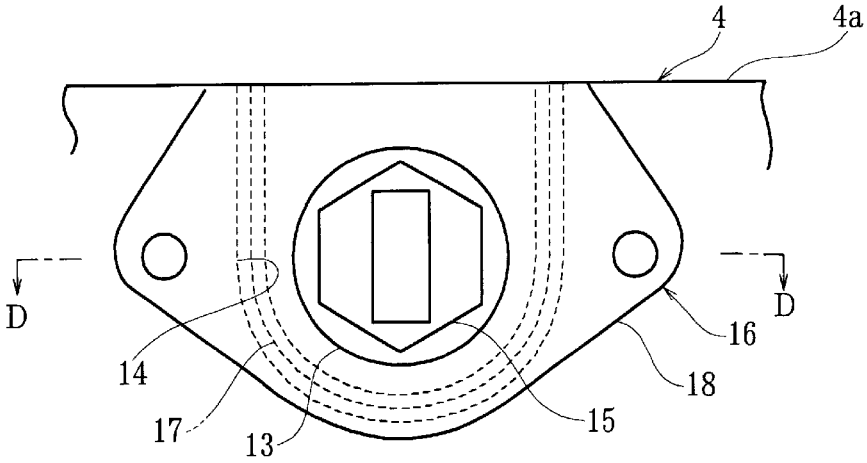
FIG. 6 is a view shown from the direction E in FIG. 4.

As shown in detail in FIGS. 4 to 6, the second sealing member 16 is provided with a rubber body 17 having a first hole 17*a* into which the second short pipe 13 can fit and a plate 18 having a second hole 18*a* into which the second short pipe 13 can fit. The rubber body 17 is loosely inserted into the almost U-shaped cutout 14 and the plate 18 is installed on the surface of the sidewall 4*a* of the cylinder head 4 by bolts (not illustrated) so as to contact the outer face of the rubber body 17. Moreover, an inside lip 17*b* in contact with the outer periphery of the second short pipe 13 under pressure is protruded from the inner periphery of the rubber body 17 and a back lip 18*b* in contact with the surface of the sidewall 4*a* of the cylinder head 4 under pressure is protruded from the back of the plate 18.

According to the fuel supply system constituted as described above, it is possible to decrease the lengths of a plurality of second fuel pipes 8 for respectively connecting between each injection nozzle 6 provided every cylinder and the common rail 3 compared to the conventional case and moreover, decrease the number of fuel pipes disposed at the outside of the cylinder head cover 5 compared to the conventional case because not a plurality of second fuel pipes 8 but only the single first fuel pipe 7 is disposed at the outside of the cylinder head cover 5. As a result, it is possible to reduce the fuel supply system in weight and cost and improve the outside quality around the engine 1.

Moreover, because the pressure sensor 15 is installed at the outside of the cylinder head 4 and the gap between the second short pipe 13 and the cutout 14 is closed by the second sealing member 16, oil in the cylinder head cover 5 is not splashed on the pressure sensor 15 by passing through the gap. That is, the oil-sealing property of the cylinder head cover 5 is secured by the second sealing member 16 and thereby, oil is avoided from leaking out of the cylinder head cover 5. Therefore, it is possible to securely protect the pressure sensor 15 from splashes of the oil. As a result, it is possible to use the conventional pressure sensor 15 having a low oil resistance.

Moreover, because the gap between the first short pipe 10 and the through-hole 11 is comparatively-largely formed, it is possible to increase the tolerance of a setting position of the first short pipe 10 to the through-hole 11. Also, because the gap between the second short pipe 13 and the cutout 14 is comparatively-largely formed, it is possible to increase the tolerance of a setting position of the second short pipe 13 to the cutout 14.

Figure 7:
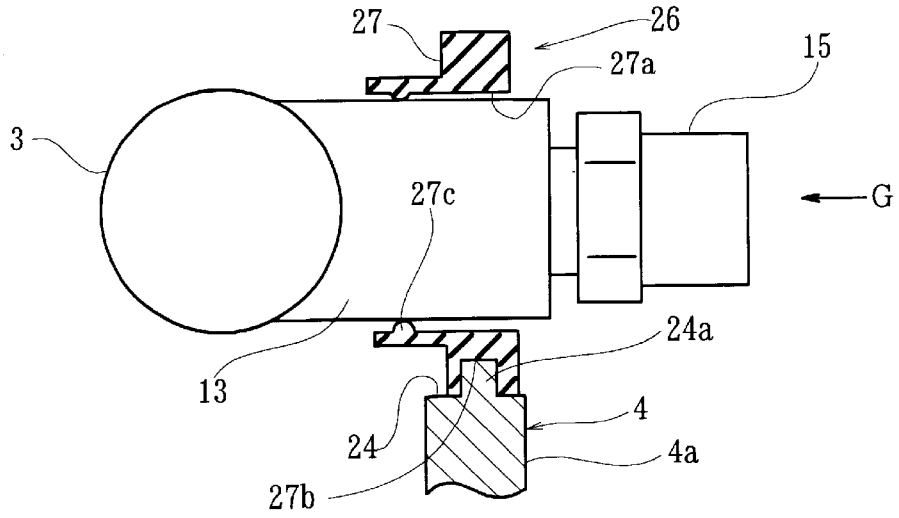
FIG. 7 is an enlarged sectional view corresponding to FIG. 4 showing a second embodiment of the present invention.
Figure 8:
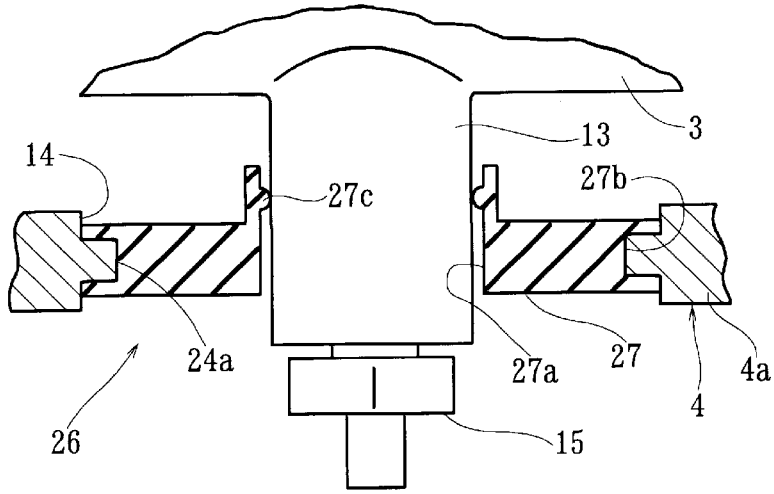
FIG. 8 is a sectional view taken along the line F—F in FIG. 9.
Figure 9:
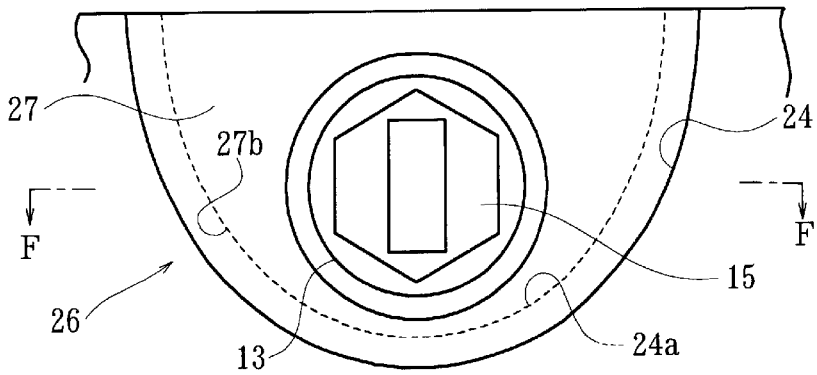
FIG. 9 is a view shown from the direction G in FIG. 7.

FIGS. 7 to 9 show second embodiment of the present invention. In FIGS. 7 to 9, a reference numeral same as that in FIGS. 4 to 6 shows the same component.

In the case of this embodiment, an almost-circular-arc rib 24*a* is formed on the inner periphery of an almost-semicircular cutout 24 (second insertion portion) while extending in the circumferential direction of the cutout 24 and a second sealing member 26 is provided with an almost-semicircular rubber body 27 having a first hole 27*a* into which the second short pipe 13 can fit. An almost-circular-arc rib 27*b* that can be fitted to the rib 24*a* is formed on the outer periphery of the rubber body 27. The rubber body 27 is compressed by a not-illustrated cylinder head cover and fixed. An inside lip 27*c* in contact with the outer periphery of the second short pipe 13 under pressure is protruded from the inner periphery of the rubber body 27.

According to of the fuel supply system constituted as described above, the plate of the first embodiment is unnecessary. Therefore, it is possible to decrease the number of components and the setting man-hour of the second sealing member 26. Because functions and advantages other than the above mentioned are almost the same as those of the second sealing member of the first embodiment, their repetitive descriptions are omitted.

Figure 10:
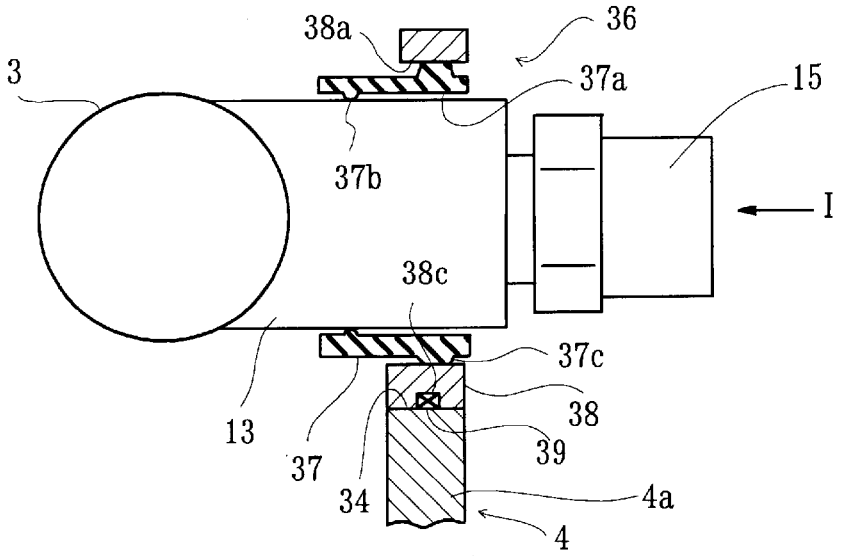
FIG. 10 is an enlarged sectional view corresponding to FIG. 4 showing a third embodiment of the present invention.
Figure 11:
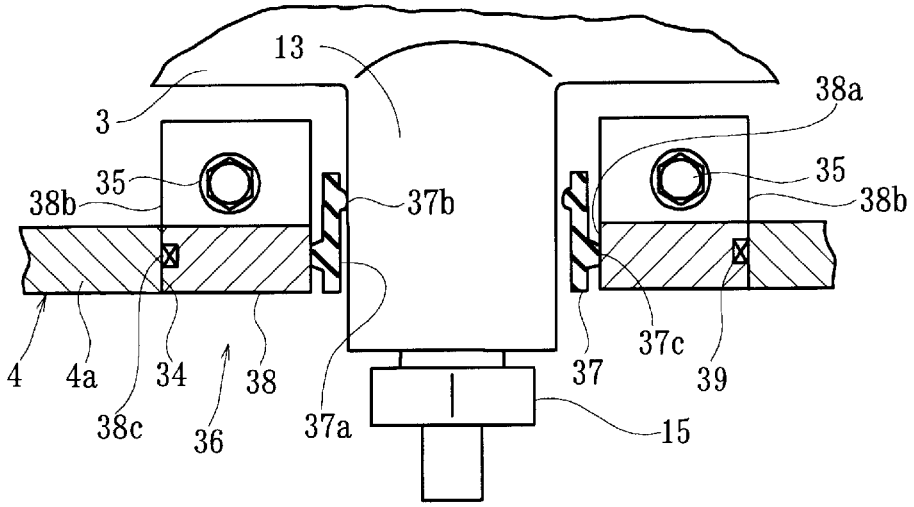
FIG. 11 is a sectional view taken along the line H—H in FIG. 12.
Figure 12:
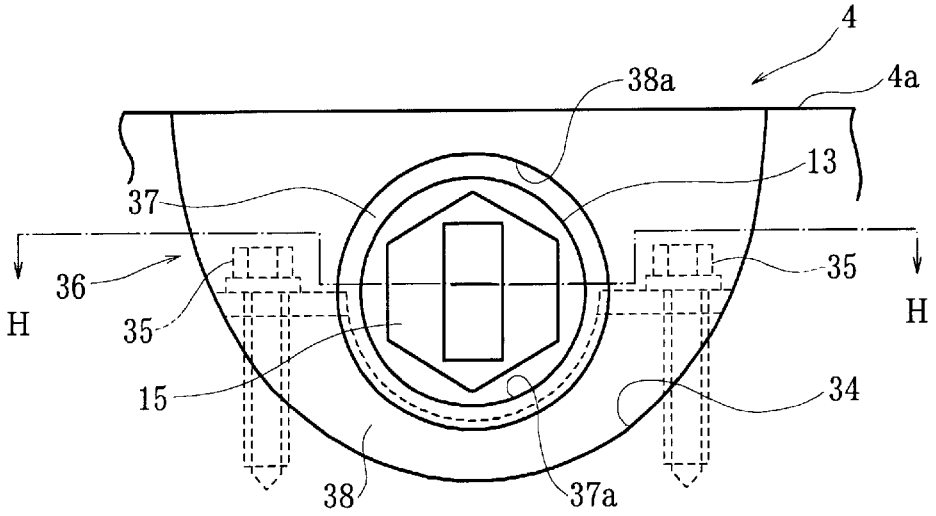
FIG. 12 is a view shown from the direction I in FIG. 10.

FIGS. 10 to 12 show third embodiment of the present invention. In FIGS. 10 to 12, a reference numeral same as that in FIGS. 4 to 6 shows the same component.

In the case of this embodiment, a second sealing member is provided with a rubber body 37 having a first hole 37*a* into which a second short pipe 13 can fit and an outer shape which can be loosely inserted into an almost-semicircular cutout 34 (second insertion portion), a plate 38 having a second hole 38*a* into which the rubber body 37 can fit and constituted so as to be inserted into the cutout 34, and a liquid gasket 39 interposed between the outer periphery of the plate 38 and the inner periphery of the cutout 34. A pair of flanges 38*b* and 38*b* is protruded from the back of the plate 38 and the plate 38 is fixed to a cylinder head 4 by screwing bolts 35 and 35 to the upper face of the cylinder head 4 through these flanges 38*b* and 38*b*. Moreover, a sealing groove 38*c* is formed on the outer periphery of the plate 38 and the liquid gasket 39 is disposed in the sealing groove 38*c*. Thereby, the gap between the outer periphery of the plate 38 and the inner periphery of the cutout 34 is closed. An inside lip 37*b* in contact with the outer periphery of the second short pipe 13 under pressure is protruded from the inner periphery of the rubber body 37 and an outside lip 37*c* in contact with the inner periphery of the cutout 34 under pressure is protruded from the outer periphery of the rubber body 37.

According to the fuel supply system constituted as described above, because the bolts 35 and 35 and the flanges 38*b* and 38*b* are covered with the cylinder head cover 5, the bolts 35 and 35 and the flanges 38*b* and 38 cannot be seen from the outside of the cover 5 and the outside quality of the second sealing member 36 is improved compared to the second sealing member of the first embodiment. Because functions and advantages other than the above mentioned are almost the same as those of the second sealing member of the first embodiment, their repetitive descriptions are omitted.

Figure 13:
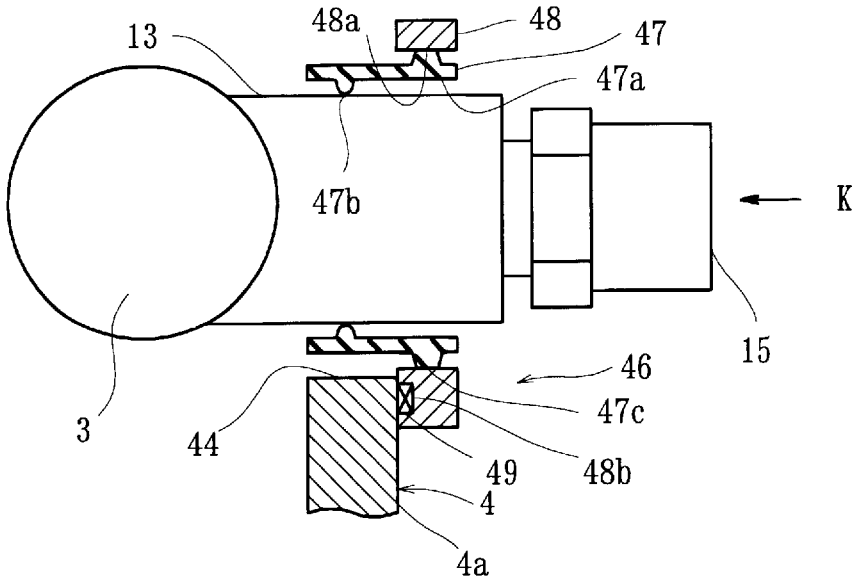
FIG. 13 is an enlarged sectional view corresponding to FIG. 4 showing a fourth embodiment of the present invention.
Figure 14:
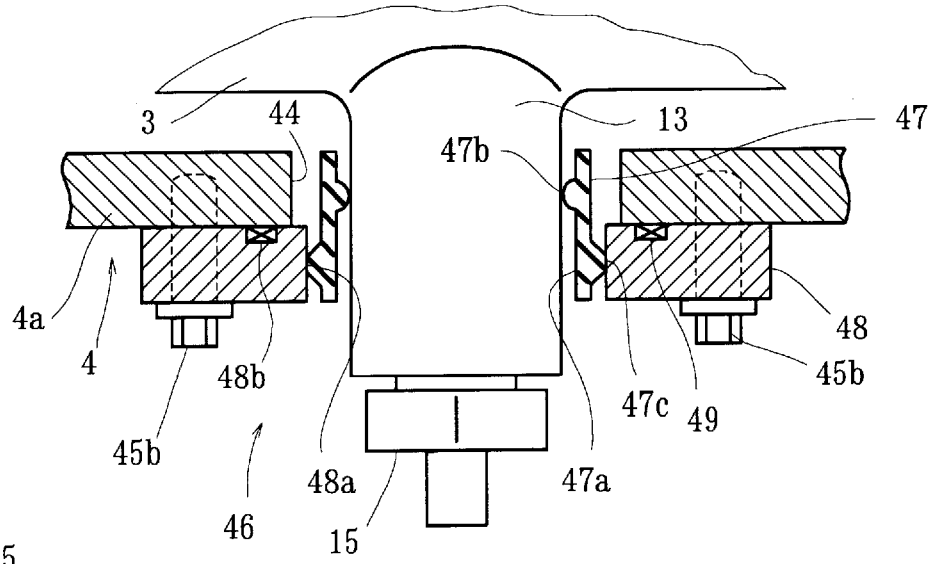
FIG. 14 is a sectional view taken along the line J—J in FIG. 15.
Figure 15:
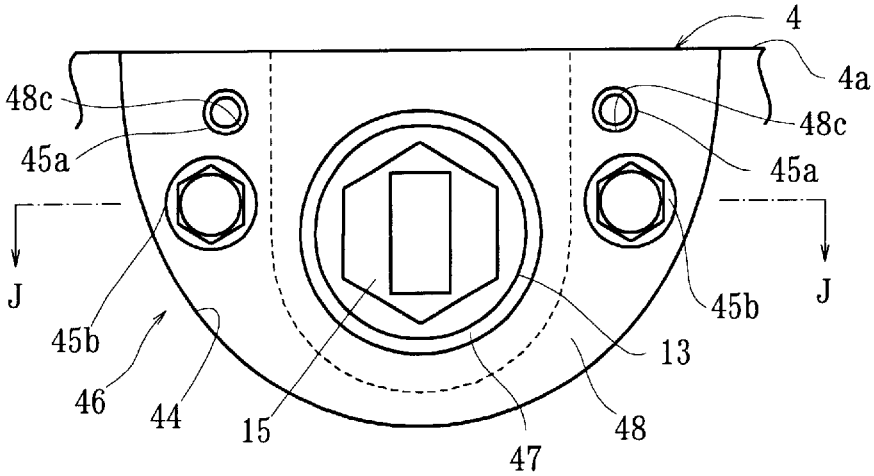
FIG. 15 is a view shown from the direction K in FIG. 13.
Figure 16:
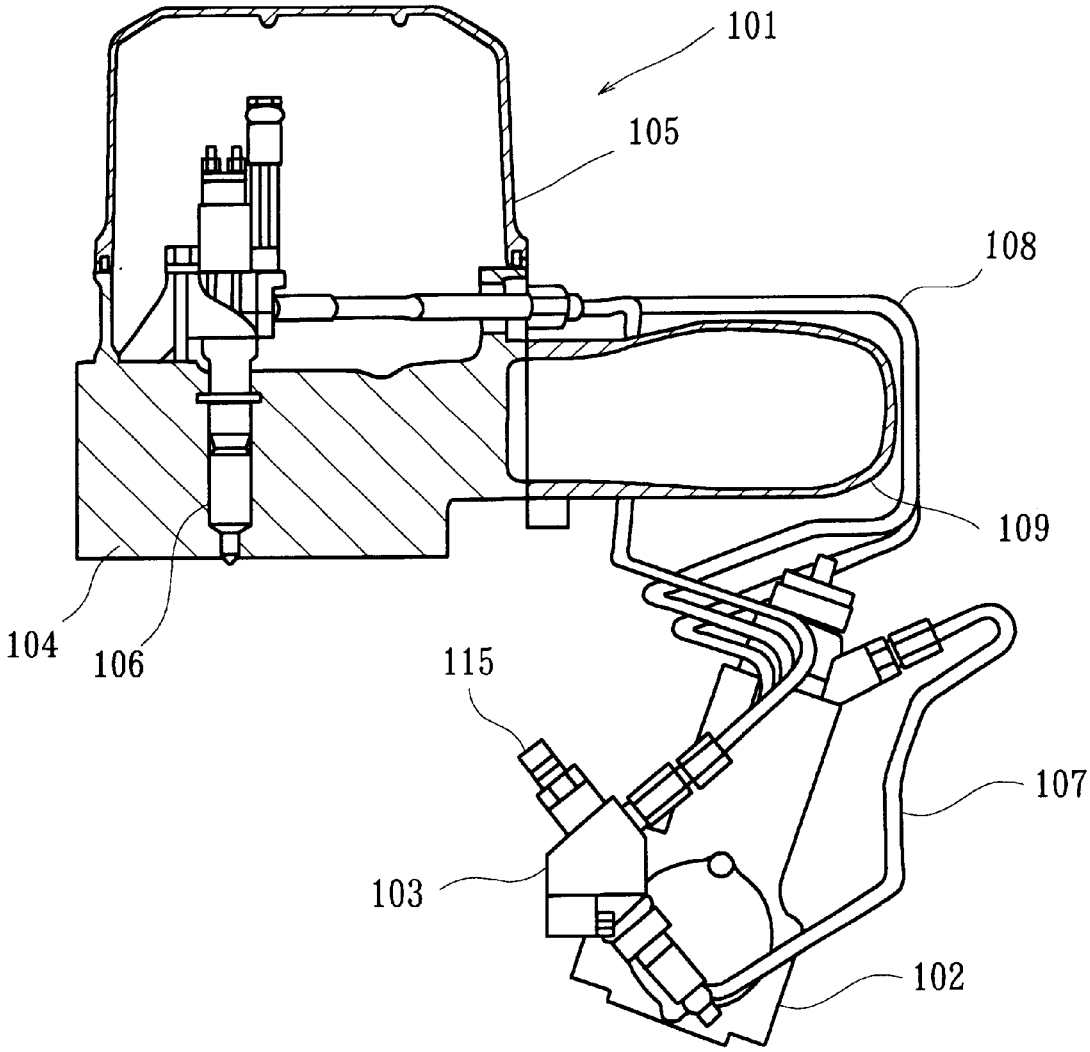
Fig.16 PRIOR ART
FIG. 16 is a sectional view corresponding to FIG. 1 showing a conventional example.

FIGS. 13 to 15 show fourth embodiment of the present invention. In FIGS. 13 to 15, a reference numeral same as that in FIGS. 4 to 6 shows the same component.

In the case of this embodiment, a second sealing member 46 is provided with a rubber body 47 having a first hole 47*a* into which a second short pipe 13 can fit and an outer shape which can be loosely inserted into an almost-U-shaped cutout 44 (second insertion portion), a plate 48 having a second hole 48*a* into which the rubber body 47 can fit, and a liquid gasket 49 interposed between the plate 48 and the installing face of the plate 48 to a cylinder head 4. The plate 48 is installed on the surface of the sidewall 4*a* of the cylinder head 4 by a pair of bolts 45*b* and 45*b* in a state in which the plate 48 is positioned by a pair of knock-pins 45*a* and 45*a* (FIG. 15). Moreover, a sealing groove 48 is formed on the back of the plate 48 and the liquid gasket 49 is disposed in the sealing groove 48*b*. Thereby, the gap between the back of the plate 48 and the surface of the cylinder head 4 is closed. An inner lip 47*b* in contact with the outer periphery of the second short pipe 13 under pressure is protruded from the inner periphery of the rubber body 47 and an outside lip 47*c* in contact with the inner periphery of the plate 48 under pressure is protruded from the outer periphery of the rubber body 47.

Then, a procedure for accurately positioning the plate 48 by the above pair of knock-pins 45*a* is described below.

First, the upper face of the plate 48 is machined simultaneously with the upper face of the sidewall 4*a* while temporarily setting the plate 48 to the sidewall 4*a* of the cylinder head 4, and pin holes 48*c* and 48*c* into which the knock-pins 45*a* and 45*a* are knocked are formed in the range from the plate 48 to the cylinder head 4. Next, the plate 48 is removed and the rubber body 47 is fitted to the second short pipe 13 and thereafter, the knock-pins 45*a* and 45*a* are knocked into the pinholes 48*c* and 48*c*. Moreover, the bolts 45*b* and 45*b* (FIGS. 14 and 15) are screwed to the sidewall 4*a* through the plate 48.

According to the fuel supply system constituted as described above, the level difference-between the upper face of the sidewall 4*a* and that of the plate 48 substantially becomes zero. Therefore, it is possible to use the upper face of the plate 48 as the fastening face of a not-illustrated cylinder head cover. Because functions and advantages other than the above mentioned are almost the same as those of the second sealing member of the first embodiment, their repetitive descriptions are omitted.

As described for the above first to fourth embodiments, when forming an almost-U-shaped or almost-semicircular cutout in the sidewall of a cylinder head and protruding the front end of a second short pipe toward the outside of the sidewall of the cylinder head, it is permitted to set a common rail to the upper face of the cylinder head while previously setting a second sealing member to the second short pipe. Thereby, it is possible to set the second sealing member simultaneously with setting of the common rail. Therefore, it is unnecessary to separately set the common rail and the second sealing member to the cylinder head and it is possible to improve the setting operability of the common rail and second sealing member.

Also, in the case of the above first to fourth embodiments, though a cutout is formed only in the sidewall of a cylinder head as a second insertion portion, it is permitted to form cutouts in both of the sidewall of a cylinder head and that of a cylinder head cover as second insertion portions, or form a through-hole only on the cylinder head cover. By forming cutouts in both of the sidewall of the cylinder head and that of the cylinder head cover, it is possible to decrease a cutout formed in the sidewall of the cylinder head in size.

Moreover, it is permitted to form the first sealing member described for the first embodiment into the same structure as the second sealing member described for the first to fourth embodiments. In this case, functions and advantages same as those of each embodiment can be obtained and the setting operability of a common rail can be improved. Furthermore, it is permitted that a first insertion portion is not a through-hole formed in the sidewall of a cylinder head but a cutout formed only in the sidewall of the cylinder head or a cutout formed in both of the sidewall of the cylinder head and that of a cylinder head cover.

As described above, according to the present invention, a common rail is housed in a cylinder head cover so as to be parallel with a crankshaft, the front end of a first short pipe protruded from the common rail faces a first insertion portion formed in the sidewall of a cylinder head, and moreover a single first fuel pipe is connected to the first short pipe through the first insertion portion. Therefore, it is possible to decrease lengths of a plurality of second fuel pipes for connecting between each injection nozzle provided every cylinder and the common rail. Moreover, because a fuel pipe protruded toward the outside of a cylinder head cover is only a single first fuel pipe, it is possible to decrease the number of fuel pipes disposed to the cylinder head side compared to the conventional case. As a result, it is possible to decrease a fuel supply system in weight and cost and improve the outside quality of the fuel supply system.

Furthermore, by closing the gap between a nut and a first insertion portion by a first sealing member, it is possible to securely prevent oil splashes in a cylinder head cover from leaking from the gap to the outside of the cover.

Furthermore, by protruding the front end of a second short pipe protruded from a common rail outward by passing through a second insertion portion formed in the sidewall of a cylinder head and installing a pressure sensor for detecting a fuel pressure in the common rail at the front end of the second short pipe, oil in the cylinder head cover is hardly splashed on the pressure sensor by passing through the gap.

Furthermore, by closing the gap between a second short pipe and a second insertion portion by a second sealing member, oil in a cylinder head cover is not splashed on a pressure sensor at all by passing through the gap. Therefore, it is possible to directly use a conventional inexpensive pressure sensor having a low oil resistance.

What is claimed is:

1. A fuel supply system of a diesel engine including a plurality of injection nozzles one ends of which are respectively inserted into a cylinder head every cylinder and other ends of which are covered with a cylinder head cover and a single common rail provided in parallel with a crankshaft, the common rail being connected to a fuel injection pump through a single first fuel pipe and being connected to the injection nozzles through a plurality of second fuel pipes, wherein the common rail is housed in the cylinder head cover the front end of a first short pipe protruded from the common rail faces a first insertion portion formed in the sidewall of the cylinder head, and the first fuel pipe is connected to the first short pipe through the first insertion portion.

2. The fuel supply system according to claim 1, wherein a male screw is formed at the front end of a first short pipe, a nut to be screwed to the male screw is provided at an end of a first fuel pipe, the first fuel pipe is connected to the first short pipe by screwing the nut to the male screw while the nut is loosely inserted into a first insertion portion, and the gap between the nut and the first insertion portion is closed by a first sealing member.

3. The fuel supply system according to claim 2, wherein a first sealing member is provided with a rubber body having a first hole into which a nut can fit and an outer shape which can be loosely inserted into a first insertion portion and a plate having a second hole into which the nut can loosely fit and constituted so as to be installed on the sidewall surface of a cylinder head by contacting the outer face of the rubber body.

4. The fuel supply system according to claim 2, wherein a rib is formed on the inner periphery of a first insertion portion while extending in the circumferential direction of the insertion portion and a first sealing member is provided with a rubber body having a first hole into which a nut can fit and a groove which can be fitted to the rib on the outer periphery of the rubber body.

5. The fuel supply system according to claim 2, wherein a first sealing member is provided with a rubber body having a first hole into which a nut can fit and an outer shape which can be loosely inserted into a first insertion portion and a plate having a second hole into which the rubber body can fit and constituted so as to be inserted into the first insertion portion, and a liquid gasket interposed between the outer periphery of the plate and the inner periphery of the first insertion portion.

6. The fuel supply system according to claim 2, wherein a first sealing member is provided with a rubber body having a fist hole into which a nut can fit and an outer shape which can be loosely inserted into a first insertion portion, a plate having a second-hole into which can be fitted into the rubber body and constituted so as to be installed on the sidewall surface of a cylinder head, and a liquid gasket interposed between the plate and the installing face of the plate on the cylinder head.

7. The fuel supply system according to claim 1, further comprising a pressure sensor for detecting a fuel pressure in a common rail, wherein the front end of a second short pipe protruded from the common rail protrudes outward by passing through a second insertion portion formed in the sidewall of a cylinder head and the pressure sensor is installed at the front end of the second short pipe.

8. The fuel supply system according to claim 7, wherein the gap between a second short pipe and a second insertion portion is closed by a second sealing member.

9. The fuel supply system according to claim 8, wherein a second sealing member is provided with a rubber body having a first hole into which a second short pipe can fit and an outer shape which can be loosely inserted into a second insertion portion and a plate having a second hole into which the second short pipe can loosely fit and constituted so as to be installed on the sidewall surface of a cylinder head by contacting the outer face of the rubber body.

10. The fuel supply system according to claim 8, wherein a rib is formed on the inner periphery of a second insertion portion while extending in the circumferential direction of the portion, and a second sealing member is provided with a rubber body having a first hole into which a second short pipe can fit and a groove which can be fitted to the rib on the outer periphery of the rubber body.

11. The fuel supply system according to claim 8, wherein a second sealing member is provided with a rubber body having a first hole into which a second short pipe can fit and an outer shape which can be loosely inserted into a second insertion portion, a plate having a second hole into which the rubber body can fit and constituted so as to be inserted into the second insertion portion, and a liquid gasket interposed between the outer periphery of the plate and the inner periphery of the second insertion portion.

12. The fuel supply system according to claim 8, wherein a second sealing member is provided with a rubber body having a first hole into which a second short pipe can fit and an outer shape which can be loosely inserted into a second insertion portion, a plate having a second hole into which the rubber body can fit and constituted so as to be installed on the sidewall surface of a cylinder head, and a liquid gasket interposed between the plate and the installing face of the plate on the cylinder head.

* * * * *